US006035812A

United States Patent [19]

Harrigill et al.

[11] Patent Number: 6,035,812

[45] Date of Patent: Mar. 14, 2000

[54] COMBUSTION AIR SHUTOFF SYSTEM FOR A FUEL-FIRED HEATING APPLIANCE

[75] Inventors: William T. Harrigill, Montgomery; Jacob H. Hall, Dadeville, both of Ala.

[73] Assignee: The Water Heater Industry Joint Research and Development Consortium, Reston, Va.

[21] Appl. No.: 09/184,838

[22] Filed: Nov. 2, 1998

[51] Int. Cl.[7] ..... F22B 37/42

[52] U.S. Cl. ..... 122/504; 122/504.1; 122/504.3; 122/DIG. 7; 126/287.5; 126/112

[58] Field of Search ..... 122/504, 504.1, 122/504.3, DIG. 7, 448.1; 126/287.5, 112

[56] References Cited

U.S. PATENT DOCUMENTS

| | | | |
|---|---|---|---|
| 2,870,827 | 1/1959 | Brockbank | 158/42.4 |
| 2,950,755 | 8/1960 | Frecourt | 158/136 |
| 3,112,788 | 12/1963 | Dunston | 158/42.4 |
| 3,469,569 | 9/1969 | Brockbank | 126/116 |
| 3,680,999 | 8/1972 | Hill | 431/21 |
| 3,800,816 | 4/1974 | Follett | 137/75 |
| 4,362,146 | 12/1982 | Schuller | 126/287.5 |
| 4,404,983 | 9/1983 | Scheurenbrand et al. | 137/74 |
| 4,437,829 | 3/1984 | Baker | 431/21 |
| 4,549,717 | 10/1985 | Dewaegheneire | 251/111 |
| 4,646,847 | 3/1987 | Colvin | 169/49 |
| 4,823,770 | 4/1989 | Loeffler | 126/362 |
| 4,858,517 | 8/1989 | Coker . | |
| 5,791,298 | 8/1998 | Rodgers | 122/17 |
| 5,797,355 | 8/1998 | Bourke et al. | 122/13.1 |
| 5,797,358 | 8/1998 | Brandt et al. | 122/448.1 |

FOREIGN PATENT DOCUMENTS

| | | | |
|---|---|---|---|
| 157009 | 6/1954 | Australia | 431/21 |
| 25384 | 5/1883 | Germany | 137/74 |

*Primary Examiner*—Denise L. Ferensic
*Assistant Examiner*—Jipihg Lin
*Attorney, Agent, or Firm*—Konneker & Smith, P.C.

[57] ABSTRACT

A fuel-fired water heater has a combustion chamber disposed above a wall structure forming a flow path for combustion air being drawn into the combustion chamber during firing of the fuel burner portion of the water heater. A combustion air shutoff system is incorporated in the water heater and functions to sense an undesirably high firing temperature in the combustion chamber and responsively shut off essentially all further air flow to the combustion chamber and thereby terminate combustion therein. In various disclosed embodiments thereof, the combustion air shutoff system includes a damper member movable between an open position in which its permits air flow through the combustion air flow path, and a closed position which it blocks essentially all further air flow through the combustion air flow path. The damper is releasably held in its open position by a eutectic metal fusible link member positioned exteriorly adjacent an exterior wall of the combustion chamber. When a predetermined high limit firing temperature is reached within the combustion chamber, the correspondingly increased temperature of the combustion chamber wall melts the fusible link member. In response, the shutoff system causes the damper to move to its closed position to terminate essentially all further flow of combustion air through the combustion air flow path into the combustion chamber.

15 Claims, 6 Drawing Sheets

FIG.2
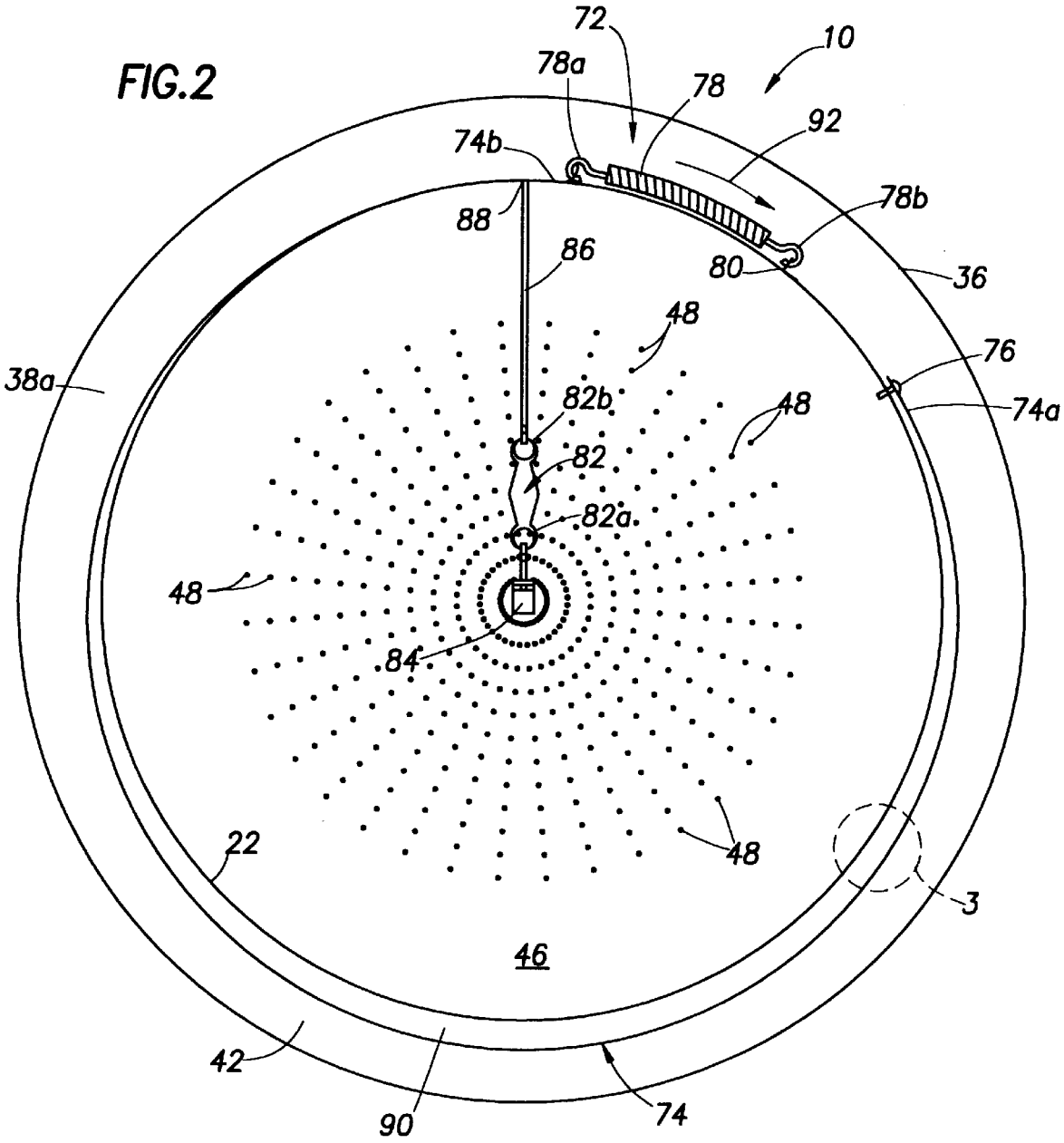
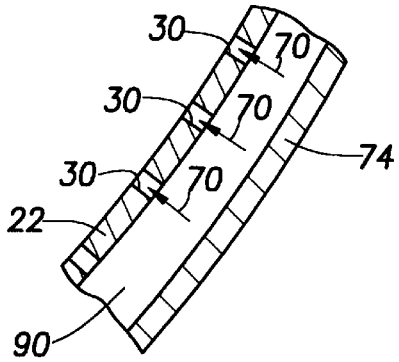
FIG.3

FIG.2A
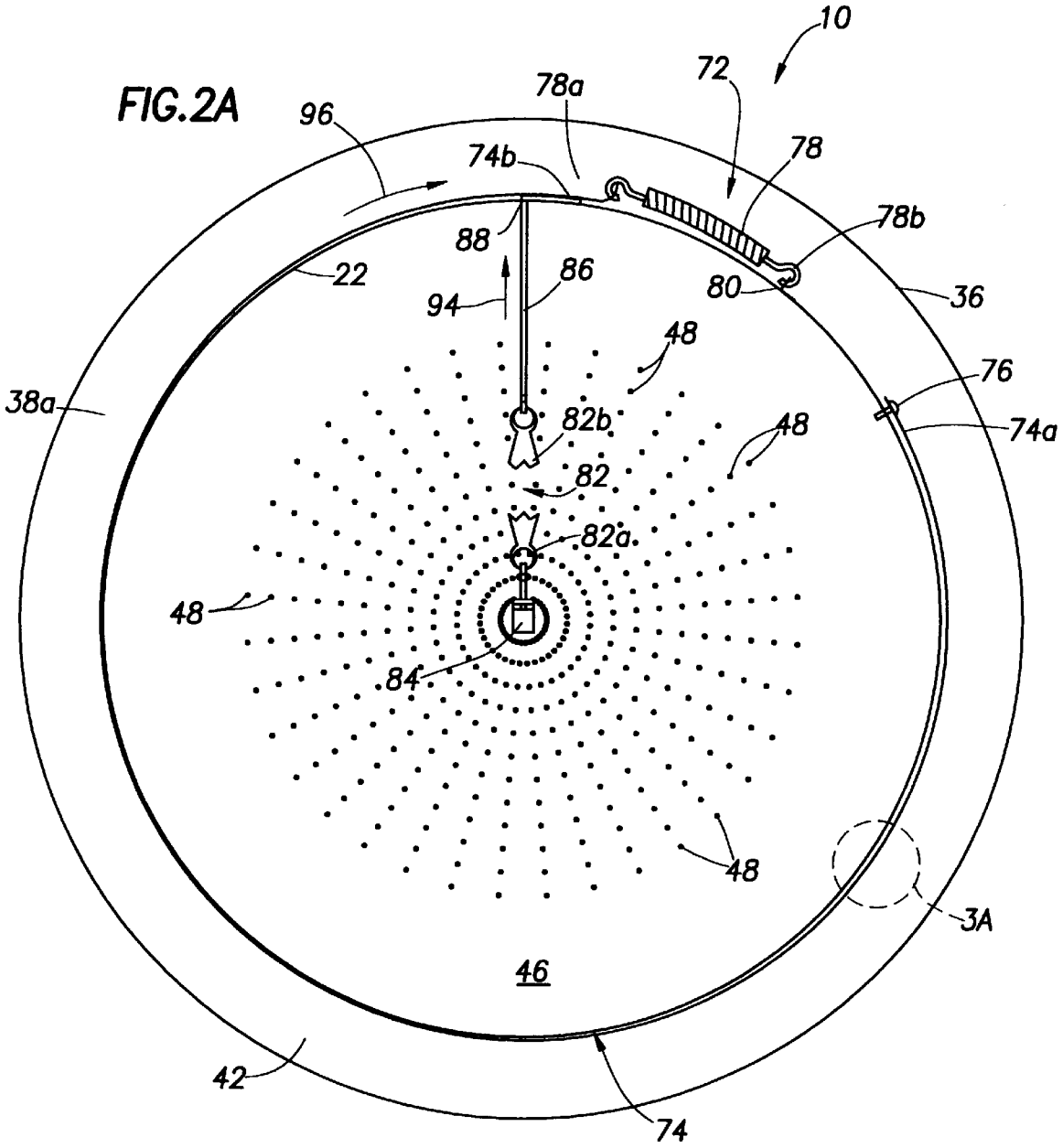
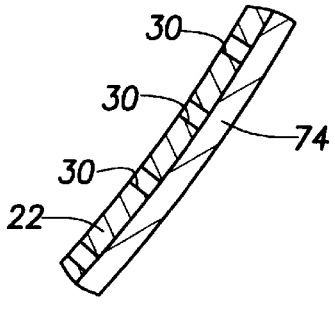
FIG.3A

COMBUSTION AIR SHUTOFF SYSTEM FOR A FUEL-FIRED HEATING APPLIANCE

BACKGROUND OF THE INVENTION

The present invention generally relates to fuel-fired heating appliances and, in a preferred embodiment thereof, more particularly provides a gas-fired water heater having incorporated therein a specially designed combustion air shutoff system.

Gas-fired residential and commercial water heaters are generally formed to include a vertical cylindrical water storage tank with a gas burner disposed in a combustion chamber below the tank. The burner is supplied with a fuel gas through a gas supply line, and combustion air through one or more air inlet openings providing communication between ambient air and the interior of the combustion chamber.

Water heaters of this general type are extremely safe and quite reliable in operation. However, under certain operational conditions the temperature within the combustion chamber may rise to an undesirable level. Accordingly, it would be desirable, from an improved overall control standpoint, to incorporate in this type of fuel-fired water heater a system for sensing this undesirable combustion chamber temperature rise and responsively terminating the firing of the water heater. It is to this goal that the present invention is directed.

SUMMARY OF THE INVENTION

In carrying out principles of the present invention, in accordance with a preferred embodiment thereof, a fuel-fired heating appliance, representatively a gas-fired water heater, is provided with a specially designed combustion air shutoff system. The appliance includes a combustion chamber thermally communicatable with a fluid to be heated, a fuel supply structure operative to deliver fuel from a source thereof into the combustion chamber, and a wall structure defining a path through which the entire required combustion air quantity may flow from a source thereof into the combustion chamber for mixture and combustion with delivered fuel therein.

From a broad perspective, the combustion air shutoff system is operative to sense a temperature indicative of an undesirably high operating or firing temperature within the combustion chamber and responsively block essentially all further air flow through the combustion air path, thereby terminating combustion within the combustion chamber. The combustion air shutoff system includes a linkage structure and a damper member. The linkage structure includes a fusible link member, representatively formed from a suitable eutectic metal material, exposed to heat generated by fuel/air combustion within the combustion chamber and being meltable at the predetermined temperature indicative of an undesirably high operating temperature within the combustion chamber. The damper member is held by the linkage structure in an open position permitting operative combustion air flow through the wall structure path, the damper member being urged toward a closed position in which the damper member blocks combustion air flow through the path. Melting of the fusible link member is operative to permit movement of the damper member from its open position to its closed position.

The preferred water heater embodiment of the fuel-fired heating appliance has a tank adapted to hold a quantity of water, a combustion chamber disposed beneath the tank and having a bottom side wall structure with a spaced series of air inlet openings therein, and a fuel burner operative to receive fuel from a source thereof and deliver the received fuel into the combustion chamber. Illustratively, the bottom side wall structure air inlet openings are configured to freely permit upward combustion air flow therethrough into the combustion chamber, while at the same time hinder flame outflow downwardly therethrough.

A hollow cylindrical skirt structure extends downwardly beyond the bottom side wall structure and has a vertical side wall portion with a spaced series of inlet openings formed therein for permitting a combustion air inflow therethrough into the interior of the hollow skirt structure for delivery therefrom into the combustion chamber, via the spaced series of combustion air inlet openings in the bottom side wall structure of the combustion chamber, for combustion with burner-delivered fuel therein.

The water heater combustion air shutoff system includes a linkage structure including a fusible link member disposed adjacent an exterior side portion of the bottom side wall structure of the combustion chamber, the fusible link member being positioned to receive heat from the underside of the bottom side wall structure and being meltable at the predetermined temperature indicative of an undesirably high operating temperature within the combustion chamber. The water heater combustion air shutoff system also includes a damper member held by the linkage structure in an open position permitting operative combustion air flow through the interior of the skirt structure and into the combustion chamber via the air inlet openings in the bottom side wall structure. The damper member is urged toward a closed position in which it blocks operative combustion air flow through the interior of the skirt structure. Melting of the fusible link member is operative to permit movement of the damper member from its open position to its closed position.

In a first embodiment of the combustion air shutoff system the damper member is a flexible band member horizontally extending exteriorly around the skirt structure and having a first end anchored thereto. A second end of the band member is circumferentially away from the first band member end to orient the band member in its open position in which the band member is spaced outwardly apart from and uncovers the inlet openings in the skirt structure, and circumferentially movable toward the first band member end to orient the band member in its closed position in which it overlies and blocks the skirt structure inlet openings. The movable second end of the flexible band member is circumferentially spring-biased toward its fixed first end, and the linkage structure extends between the bottom side wall structure and the second band member end and includes a flexible cable member in which the fusible link member is installed.

In a second embodiment of the combustion air shutoff system the system further includes a first plate member horizontally secured within the skirt structure above the inlet openings therein and below the bottom side wall structure of the combustion chamber, the first plate member having an opening therein. The damper member is a second plate member supported in the open position by the fusible link member horizontally with the skirt structure below the bottom side wall structure of the combustion chamber and above the opening in the first plate member. The second plate member is movable downwardly to its closed position, in which the second plate member rests atop the first plate member and blocks the opening therein, in response to melting of the fusible link member. Illustratively, the second plate member is spring-biased downwardly from its open position toward its closed position.

In a third embodiment of the combustion air shutoff system the damper member is an annular damper slidably telescoped with the skirt structure for gravity-created downward movement from its open position, in which the annular damper is positioned above and uncovers the inlet openings in the vertical side wall portion of the skirt structure, to its closed position, in which the annular damper blocks the inlet openings in the vertical side wall portion of the skirt structure.

Preferably, the skirt structure and the annular damper in its open position have aligned retaining openings, and the linkage structure includes at least one retainer arm member supported for rotation about a vertical axis and having an outer end portion which, when the annular damper is in its open position, extends through the aligned retaining openings and releasably supports the annular damper in its open position. A spring member associated with the retainer arm member is operative, in response to melting of the fusible link member, to rotate the retainer arm member in a manner retracting the outer end portion thereof from the aligned retaining openings and permitting the annular damper to fall from its open position to its closed position.

BRIEF DESCRIPTION OF THE DRAWINGS

FIG. 2 is an enlarged scale partially schematic cross-sectional view through the water heater, taken along line 2—2 of FIG. 1, with a control damper portion of the combustion air shutoff system being in its open position;

FIG. 2A is a view similar to that in FIG. 2, but with the control damper portion of the combustion air shutoff system being in its closed position;

FIG. 3 is an enlarged scale cross-sectional detail view of the dashed circle area "3" in FIG. 2;

FIG. 3A is an enlarged scale cross-sectional detail view of the dashed circle area "3A" in FIG. 2A;

DETAILED DESCRIPTION

Figure 1:
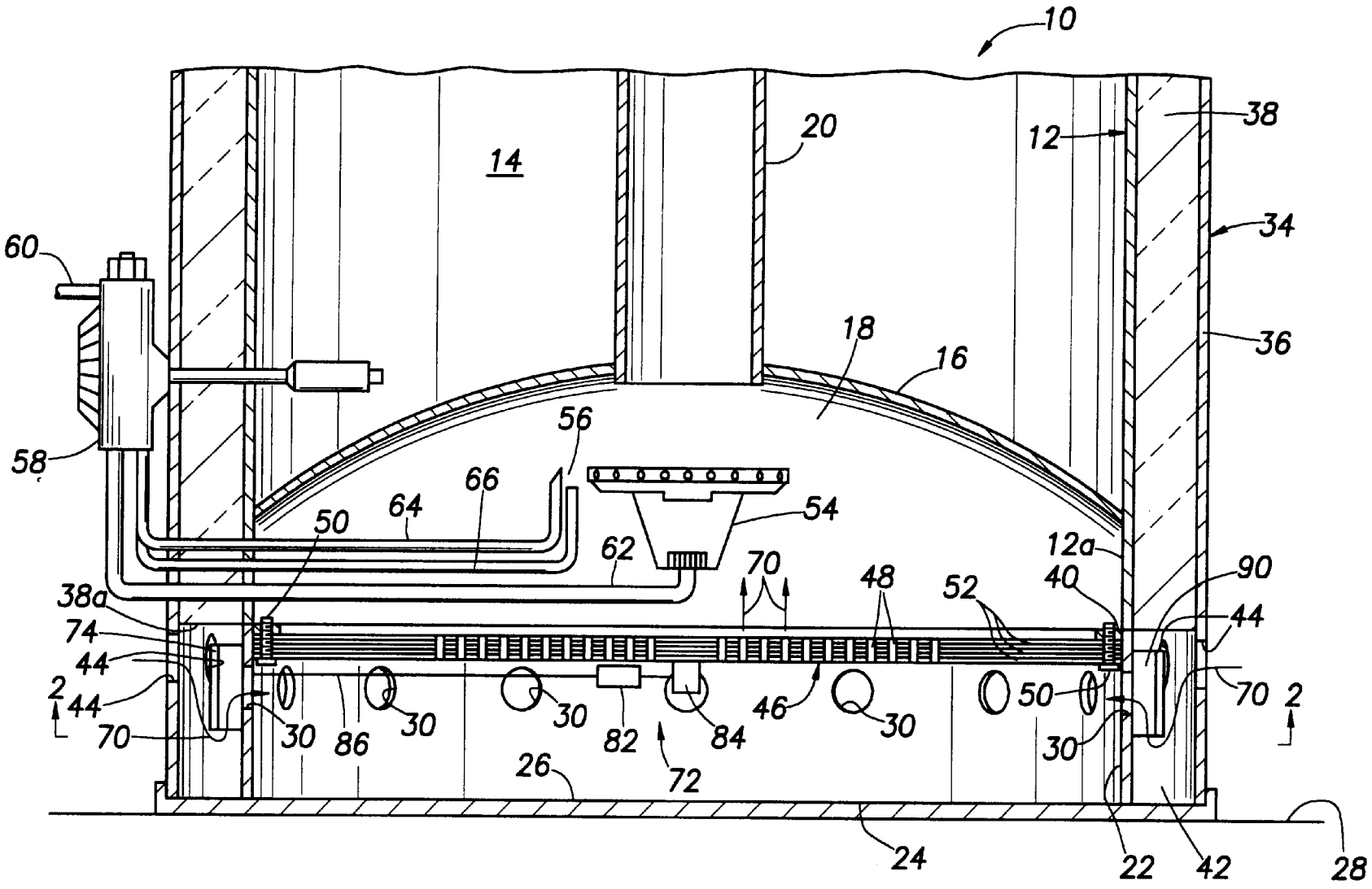
FIG. 1 is a simplified partial cross-sectional view through a representative gas-fired water heater having incorporated therein a specially designed combustion air shutoff system embodying principles of the present invention.

Cross-sectionally illustrated in simplified form in FIG. 1 is a lower end portion of a specially designed fuel-fired water heater 10 embodying principles of the present invention. Illustratively, the fuel-fired water heater 10 is a gas-fired water heater utilizing natural or liquified petroleum gas, but could alternatively be an oil-fired water heater or other type of fuel-fired fluid heating appliance.

Water heater 10 has a vertically oriented cylindrical metal water storage tank 12 in which a quantity of heated water 14 is stored, the tank 12 having an upwardly domed bottom head portion 16 that defines the upper wall of a combustion chamber 18 which communicates with the open lower end of a combustion flue tube 20 that centrally extends upwardly through the interior of the tank 12. An annular outer side wall portion of the combustion chamber 18 is defined by an annular lower end portion 12*a* of the tank 12 which extends downwardly past the periphery of the bottom head portion 16. In a conventional manner, suitable outlet and inlet pipes (not shown) are connected to the tank 12 to respectively flow heated water out of the tank and flow water to be heated into the tank.

The lower end portion 12*a* of the tank 12 is supported atop an annular skirt structure 22 having an open lower end 24 which is received in a bottom pan member 26 that rests on a suitable horizontal support surface such as the indicated floor 28. A circumferentially spaced array of combustion air inlet openings 30 are formed in the vertical side wall portion of the skirt structure 22.

Outwardly circumscribing the tank 12 is a cylindrical insulating jacket structure 34 having an annular outer metal jacket portion 36 which is coaxial with the tank 12 and spaced outwardly therefrom. A suitable insulation material, such as foam insulation 38, is disposed within the annular space between the metal jacket portion 36 and the tank 12. The lower end of the metal jacket portion 36 is received within the bottom pan 26, and the insulation 38 has an annular lower end surface 38*a* which is spaced upwardly apart from the lower end of the jacket portion 36 and is vertically adjacent an annular, inturned flange 40 formed on the upper end of the skirt 22. The absence of insulation 38 vertically along the skirt 22 forms an annular air intake plenum space 42 between the skirt 22 and a lower end section of the jacket portion 36. At the upper end of the plenum 42 a circumferentially spaced series of air inlet openings 44 are formed in the jacket portion 36.

The combustion chamber 18 has a circular bottom side wall structure 46 with combustion air inlet openings 48 formed therein and extending between the interior of the skirt 22 and the interior of the combustion chamber 18. Bottom side wall structure 46 forms an outer wall portion of the combustion chamber 18 and is positioned beneath the skirt flange 40, with an annular high temperature sealing gasket (not visible in FIG. 1) being interposed between a peripheral edge portion of the bottom side wall structure 46 and the skirt flange 40. This peripheral edge portion of the bottom side wall structure 46 is sealed to the underside of the flange 40 by a circumferentially spaced series of screws 50 extending upwardly through the periphery of the bottom side wall structure 48 and the flange 40 and compressing the gasket therebetween.

In a manner similar to that illustrated and described in pending U.S. application Ser. No. 09/003,634, which is assigned to the same assignee as the present application and is hereby incorporated herein by reference, the bottom side wall structure 46 is preferably formed from a stacked plurality of circular perforated metal plates 52 (representatively four in number), with the perforations in the plates 52 being in registry with one another to combinatively define the spaced series of vertical combustion air intake openings 48 that vertically extend from the bottom side of the bottom side wall structure 46 to its top side. The illustrated openings 48 have circular cross-sections along their lengths, but could alternatively have other crosssectional configurations. While the bottom side wall structure 48 is preferably formed from a stacked plurality of perforated plates, it will be appreciated that if desired it could be alternatively formed from a single, thicker plate.

A conventional gas burner 54 and an associated pilot and thermocouple assembly 56 are suitably supported within the combustion chamber 18. To provide external visibility of the burner flame within the combustion chamber, a suitable sight glass structure of conventional construction (not shown) is provided on the water heater. A thermostatic gas supply valve 58, which monitors the temperature of the stored tank water 14 and correspondingly controls the firing of the burner 54, to maintain a predetermined tank water temperature, is externally mounted on the outer side of the jacket structure 34 on the left side of the water heater 10 as viewed in FIG. 1.

Thermostatic valve 58 receives a supply of gaseous fuel, from a source thereof, through a gas pipe 60 and is operatively coupled to (1) the burner 54 by a gas supply line 62, and (2) the pilot/thermocouple assembly 56 by a pilot gas line 64, the body 66 of the thermocouple portion of the assembly 56, and electrical wiring (not shown). Gas lines 62 and 64, the thermocouple body 66, and the electrical wiring extend into the combustion chamber 18 through an outer side portion of the water heater as shown in FIG. 1.

During operation of the water heater 10, while the burner 54 is firing, ambient combustion air 70 exteriorly adjacent the water heater 10 is sequentially drawn inwardly through the jacket openings 44, through the skirt/jacket plenum area 42, inwardly through the skirt wall openings 30 into the interior of the skirt 22, and then upwardly into the combustion chamber 18 via the openings 48 in the bottom side wall structure 46. This air flow through the interior of the skirt 22 constitutes the entire flow of combustion air delivered to the combustion chamber 18 during operation of the water heater 10. The air 70 entering the combustion chamber 18 mixes and is combusted with fuel exiting the burner 54. The resulting hot combustion gases flow upwardly through the fuel tube 20 and are used to supply heat to the tank water 14.

The combustion chamber 18 is generally sealed except at the combustion air intake openings 48 in the bottom side wall structure 46. Thus, the openings 48 define essentially the sole passage through which combustion air 70 may enter the interior of the combustion chamber 18. As illustrated and described in pending U.S. application Ser. No. 09/003,634, the thickness of the bottom plate structure 46 and the configuration of the openings 48 are preferably selected to cause the openings 48 to (1) allow the combustion air 70 to flow upwardly through the openings 48 with a pressure drop which is sufficiently low so as to not materially impede the normal combustion process of the fuel-fired water heater 10, while at the same time (2) act as flame arresting passages that hinder a downward flow of flames through the openings 48. Representatively, the thickness of the bottom sidewall structure 46 is approximately 0.25 inches, and the diameter of each of the openings 48 is approximately 0.063 inches.

Referring now to FIGS. 1–3A, according to a key aspect of the present invention the operating or "firing" temperature within the combustion chamber 18 is prevented from reaching an undesirably high level using a specially designed combustion air shutoff system 72. In a manner later described herein, the system 72 functions to (1) sense a temperature indicative of the firing temperature within the combustion chamber 18, and (2) terminate flow of combustion air into the combustion chamber when the sensed temperature reaches a predetermined magnitude indicative of an undesirably high firing temperature within the combustion chamber 18.

The combustion air shutoff system 72 includes a flexible metal combustion air shutoff band 74 which functions as a control damper and is longitudinally wrapped horizontally around the outer side of the skirt 22, at the vertical level of the combustion air inlet openings 30 therein, and has opposite ends 74*a* and 74*b* as may be best seen in FIGS. 2 and 2A. The length of the band 74 is somewhat less than the outer side circumference of the skirt 22, and the band end 74*a* is fixedly anchored to the skirt 22 by, for example, a suitable threaded fastener 76. The other end 74*b* of the band 74 is circumferentially movable relative to the skirt 22 and is anchored to a movable end 78*a* of a coiled tension spring 78 positioned on the outer side of the skirt 22, the other end 78*b* of the spring 78 being suitably anchored to the skirt 22 at a point 80 thereon between the band ends 74*a* and 74*b*.

Combustion air shutoff system 72 also includes a eutectic metal fusible link member 82 positioned downwardly adjacent or in contact with the bottom side of the bottom side wall structure 46. Fusible link member 82 has a first end 82*a* that is anchored to a central portion of the bottom side wall structure 46 by a suitable support structure 84. The opposite end 82*b* of the fusible link member 82 is secured to one end of a flexible cable member 86 which passes through an opening 88 in the skirt 22 and has its other end suitably anchored to the band end 74*b*.

As illustrated in FIGS. 2 and 3, when the combustion air shutoff system 72 is initially installed on the water heater 10, the band 74 is placed in an "open" orientation thereof, in which a substantial longitudinal portion of the band 74 is spaced horizontally outwardly apart from the outer side of the skirt to define an arcuate gap 90 between the band 74 and the skirt 22, by circumferentially moving the band end 74*b* away from the opposite band end 74*a* and thereby tensioning the spring 78. The outer end of the cable 86 is then secured to the band end 74*b* in a manner causing the cable to hold the band end 74*b* in its FIG. 2 position against the biasing force 92 of the tensioned spring 78 which resiliently urges the movable band end 74*b* in a circumferential direction toward the fixed band end 74*a*.

During normal firing conditions of the water heater 10, when the temperature within the combustion chamber 18 is below a predetermined high limit temperature, the fusible link member remains intact (as shown in FIG. 2), and combustion air 70 from within the jacket/skirt annulus 42 (see FIG. 1) passes through the band/skirt gap 90, inwardly through the skirt wall openings 30 into the skirt interior, and then upwardly through the bottom side wall structure openings 48 into the combustion chamber 18 to support the water heating combustion process therein.

However, when the predetermined high limit temperature within the combustion chamber 18 is reached, thus indicating that the combustion chamber temperature has reached an unacceptably high level, the increased heat transmitted from the bottom side wall structure 46 to the fusible link member 82 (which forms a portion of the overall linkage structure holding the band 74 in its open position) causes the fusible link member to melt, as indicated in FIG. 2A, thereby freeing the cable 86 as indicated by the arrow 94. The freeing of the cable 86 allows the tensioned spring 78 to pull the movable band end 74*b* circumferentially toward the fixed band end 74*a*, as indicated by the arrow 96 in FIG. 2A. In turn, this circumferentially tightens the band 74 to a "closed" position against the outer side of the skirt 22 and eliminates the gap 90 between the skirt 22 and the band 74, thereby blocking the skirt openings 30 (compare FIG. 3A to FIG. 3) and terminating inward air flow therethrough and correspondingly terminating combustion in the combustion chamber 18.

In this manner, the generation of an undesirably high firing temperature in the combustion chamber 18 is prevented. As will be readily appreciated by those skilled in this particular art, the maximum combustion chamber system temperature permitted by the shutoff system 72 is a function of the melting temperature of the fusible link member 82, its proximity to, and its location on the bottom side wall structure 46.

Figure 4A:
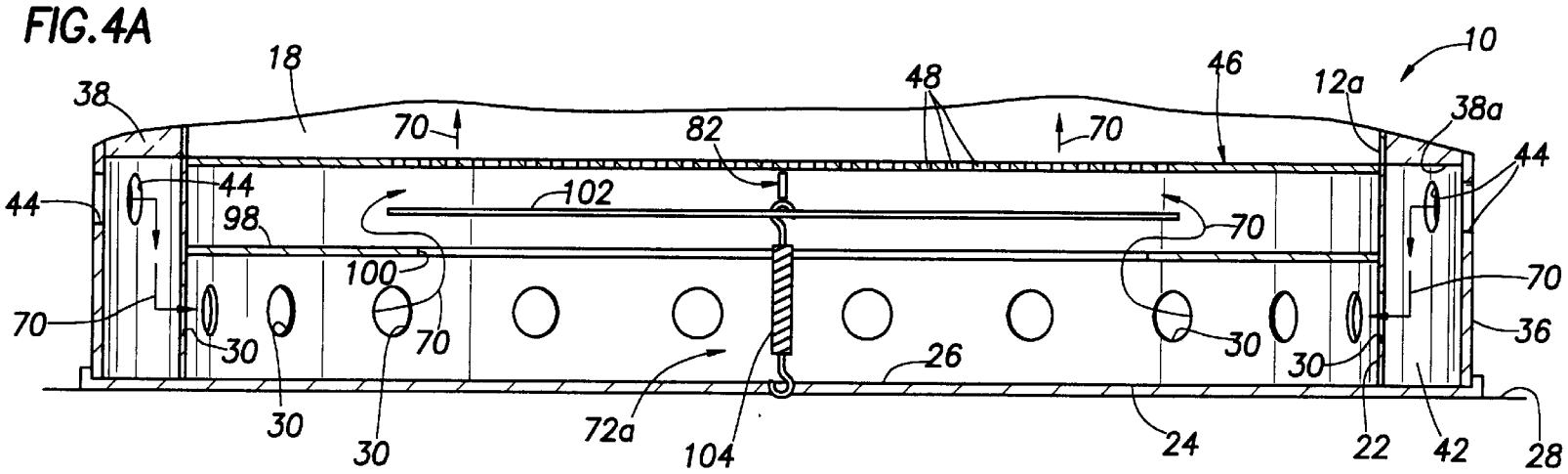
FIG. 4A is a simplified partial cross-sectional view through the water heater with a first alternate embodiment of the combustion air shutoff system being incorporated therein, the damper portion of the shutoff system being in its open position.
Figure 4B:
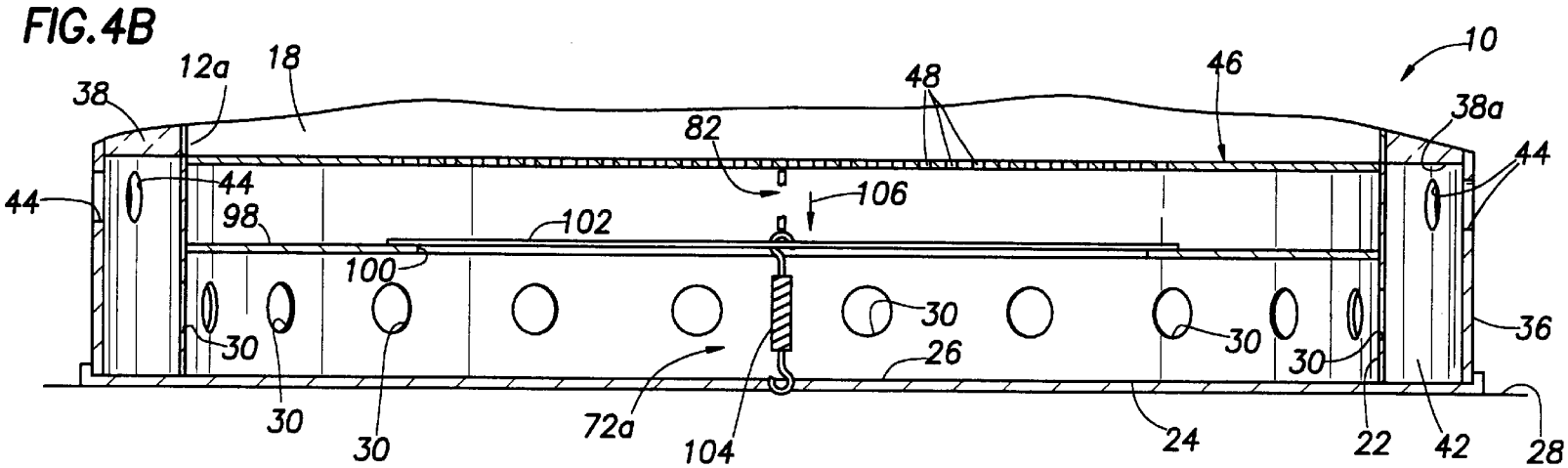
FIG. 4B is a view similar to that in FIG. 4A, but with the damper portion of the shutoff system being in its closed position.

FIGS. 4A and 4B depict in simplified form a first alternate embodiment 72*a* of the previously described combustion air shutoff system 72 incorporated in the water heater 10. In FIG. 4A the system 72*a* is shown in its open position in which it permits normal flow of ambient combustion air 70 into the combustion chamber 18, and in FIG. 4B the system 72 is shown in its closed position in which terminates the flow of combustion air 70 into the combustion chamber 18.

Referring now to FIG. 4A, the combustion air shutoff system 72*a* includes an annular metal plate 98 having a central opening 100. The plate 98 is coaxially secured within the skirt 22, above the skirt air inlet openings 30 and below the combustion chamber bottom side wall structure 46, with the periphery of the plate 98 being sealingly secured to the inner side of the skirt 22 in a suitable manner. The combustion air shutoff system 72*a* also includes a circular disc-shaped metal shutoff damper member 102 having a diameter greater than the diameter of the central opening 100 in the plate 98.

With the shutoff system 72*a* in its FIG. 4A open position, the damper member 102 is supported vertically between the combustion chamber bottom side wall structure 46 and the annular plate 98, in a coaxial, spaced apart relationship therewith, by a eutectic metal fusible link member 82 interconnected between central portions of the damper member 102 and the combustion chamber bottom side wall structure 46. As illustrated in FIG. 4A, an annular peripheral portion of the damper member radially outwardly overlaps the central opening 100 in the annular metal plate 98. A coiled tension spring member 104 is interconnected between the bottom pan 26 and a central underside portion of the damper 102 and exerts a resilient downward force on the damper 102. During normal firing of the water heater 10, as indicated in FIG. 4A, ambient combustion air 70 sequentially enters the jacket/skirt annulus 42 through the jacket openings 44, flows into the skirt interior through the skirt openings 30, flows upwardly through central opening 100 in the plate 98, and then flows around the periphery of the damper 102 and upwardly into the combustion chamber 18 via the openings 48 in the bottom side wall structure 46 of the combustion chamber.

When the predetermined high limit temperature within the combustion chamber 18 is reached, thus indicating that the combustion chamber temperature has reached an unacceptably high level, the increased heat transmitted from the bottom side wall structure 46 to the fusible link member 82 causes it to melt, as indicated in FIG. 4B. In turn, the melting of the fusible link member 82 permits the spring 104 to downwardly drive the damper member 102, as indicated by the arrow 106, against the top side of the annular plate 98 to cover the central opening 100 therein. This brings the shutoff system 72*a* to its closed position in which the spring 104 holds the damper 102 against the top side of the annular plate 98 and thereby terminates the flow of combustion air 70 into the combustion chamber 18 and correspondingly terminates combustion within the combustion chamber 18.

Figure 5A:
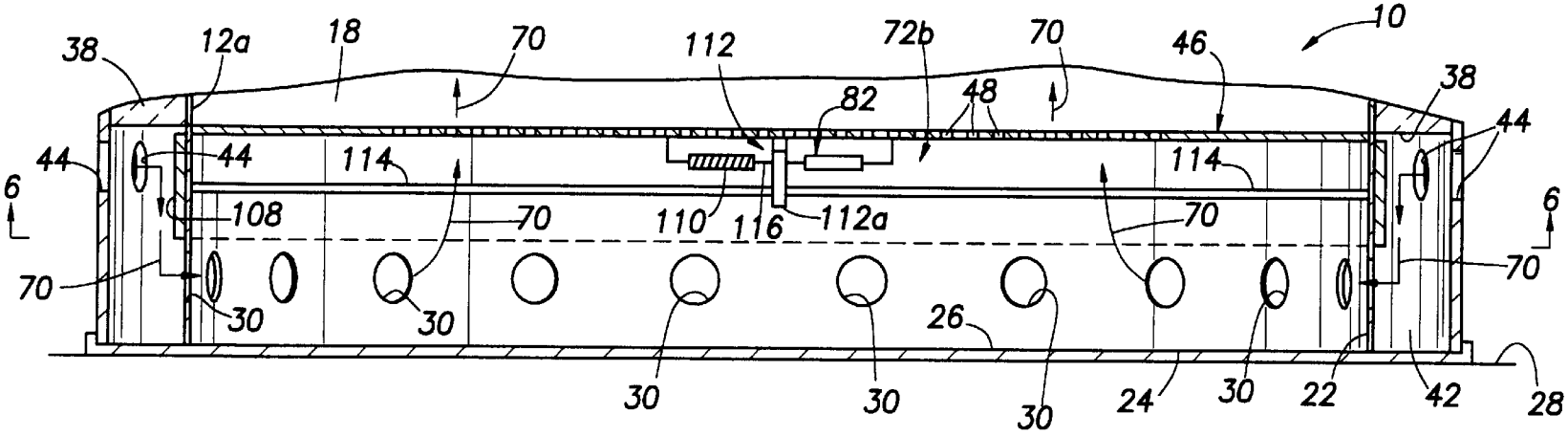
FIG. 5A is a simplified partial cross-sectional view through the water heater with a second alternate embodiment of the combustion air shutoff system being incorporated therein, the damper portion of the shutoff system being in its open position.
Figure 5B:
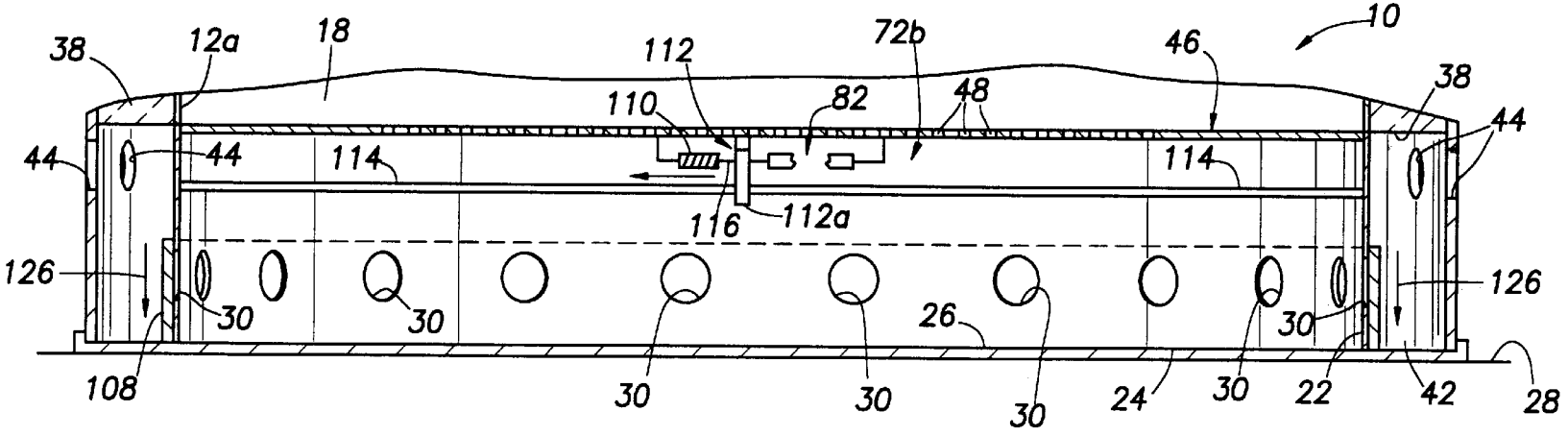
FIG. 5B is a view similar to that in FIG. 5A, but with the damper portion of the shutoff system being in its closed position.
Figure 6:
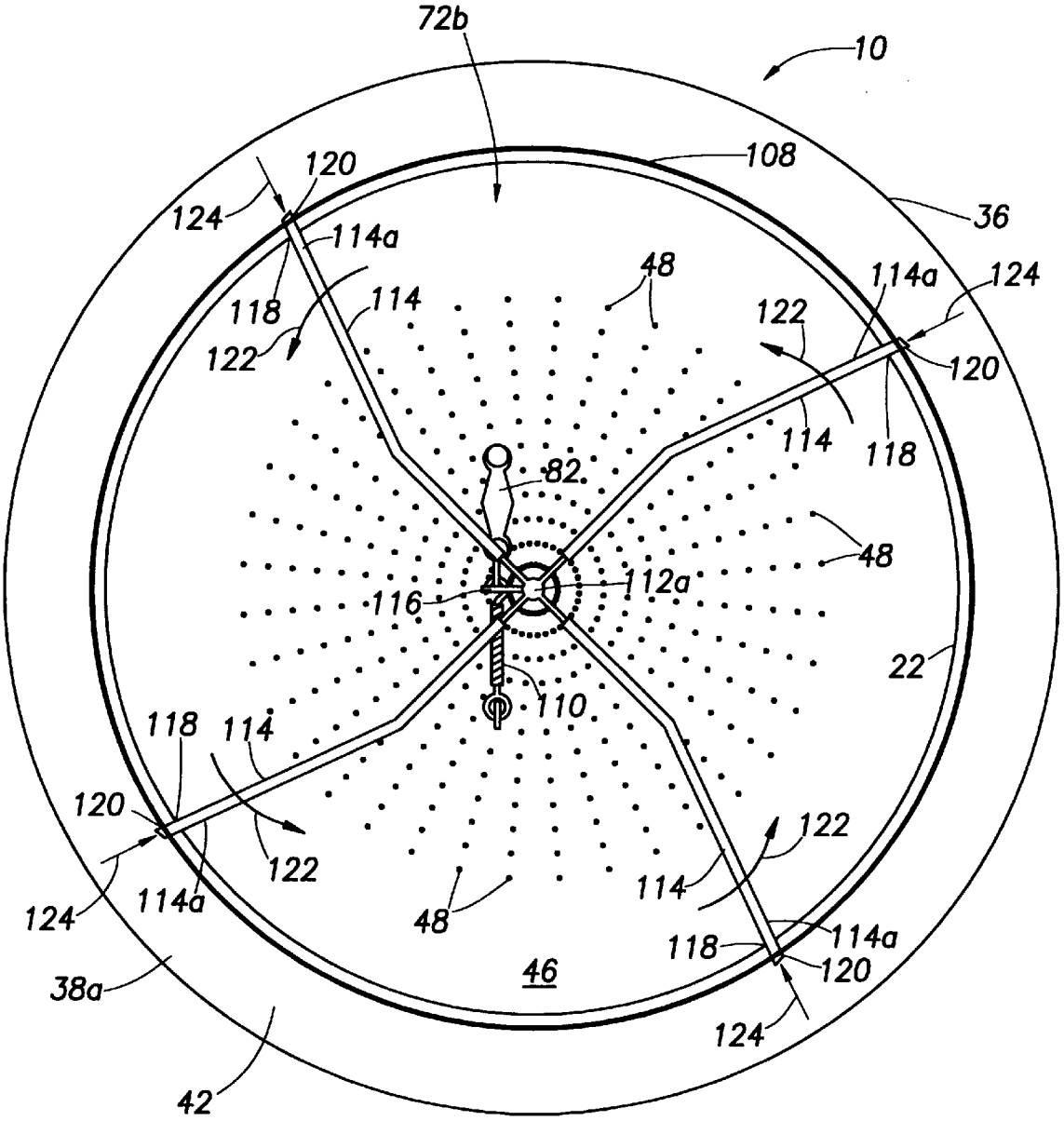
FIG. 6 is a reduced scale cross-sectional view through the water heater taken along line 6—6 of FIG. 5A.

FIGS. 5A–6 illustrate a second alternate embodiment 72*b* of the previously described combustion air shutoff system 72 incorporated in the water heater 10. FIGS. 5A and 6 depict the shutoff system 72*b* in its open position, and FIG. 5B depicts the shutoff system 72*b* in its closed position.

Referring initially to FIGS. 5A and 6, the combustion air shutoff system 72*b* includes an annular metal shutoff sleeve damper member 108, a eutectic metal fusible link member 82, a coiled tension spring 110, a support structure 112, and a plurality (representatively four in number) of elongated flexible bent retaining arm members 114. Support structure 112 is suitably secured to and depends from a central underside portion of the combustion chamber bottom side wall structure 46 and has a rotatable bottom end portion 112*a* with a transverse lever projection 116 thereon (see FIG. 6).

As best illustrated in FIG. 6, in which the shutoff system 72*b* is in its open position, the fusible link member 82 is positioned closely adjacent or against the bottom side of the combustion chamber bottom side wall structure 46, with one end of the fusible link member 82 being anchored to the bottom side wall structure 46, and the other end of the fusible link member 82 being anchored to the lever projection 116 on one side thereof. One end of the tension spring 110 is anchored to the other side of the lever projection 116, with the other end of the tension spring 110 being anchored to the combustion chamber bottom side wall structure 46. Spring 110 in its FIG. 6 orientation is tensioned and (as viewed in FIG. 6) exerts, via the lever projection 116, a counterclockwise rotational force on the rotatable bottom support structure portion 112*a*. This rotational force is resisted by the anchoring of the lever projection 116 to the bottom side wall structure 46 by the intact fusible link member 82.

The retaining arms 114 have inner ends that are suitably anchored to the rotatable support structure portion 112*a*, with the retaining arms 114 being circumferentially spaced about the rotatable support structure portion 112*a*, extending generally radially outwardly from the support structure portion 112*a*, and being vertically positioned beneath the lever projection 116. With the combustion air shutoff system 72*b* in its open position shown in FIGS. 5A and 6, the sleeve damper 108 slidably and outwardly circumscribes the skirt 22 above the skirt air inlet openings 30. Damper 108 is releasably retained in this vertically elevated open orientation by outer end portions 114*a* of the retaining arms 114 (see FIG. 6) that slidably extend radially outwardly through aligned, circumferentially spaced retaining openings 118, 120 respectively formed in the skirt 22 and the sleeve damper 108. Alternatively, the bottom peripheral edge of the sleeve damper 108 could simply rest atop the outer end portions 114*a* of the retaining arms 114.

While the sleeve damper 108 is releasably held in this vertically elevated open position by the outer ends 114*a* of the retaining arms 114, normal firing of the gas burner 54 draws combustion air 70 outwardly adjacent the water heater 10 (see FIG. 5A) sequentially inwardly through the jacket openings 44 into the jacket/skirt annular space 42, inwardly through the skirt openings 30 into the interior of the skirt 22, and then upwardly into the combustion chamber 18 via the bottom side wall structure openings 48.

However, when the predetermined high limit temperature within the combustion chamber 18 is reached, thus indicating that the combustion chamber temperature has reached an unacceptably high level, the increased heat transmitted from the bottom side wall structure 46 to the fusible link member 82 causes it to melt. The melting of the fusible link member 82 frees the lever projection 116 (see FIG. 6) to be rotated by the previously tensioned spring 110 in a counterclockwise direction. This spring-driven rotation of the lever projection 116 (and thus the support structure portion 112*a*) rotationally drives the retaining arms 114 in a corresponding counterclockwise direction as indicated by the arrows 122 in FIG. 6.

In turn, this draws the outer retaining arm ends 114*a* inwardly through the skirt and band openings 118 and 120, as indicated by the arrows 124 in FIG. 6, thereby freeing the sleeve damper 108 and permitting it to fall by gravity to its FIG. 5B closed position as indicated by the arrows 126 in FIG. 5B. The sleeve damper 108 in this closed position outwardly blocks the skirt openings 30, thereby terminating combustion air inflow to the combustion chamber 18 and correspondingly terminating combustion therein.

While the combustion air shutoff system embodiments 72,72*a* and 72*b* illustrated and described herein have been representatively incorporated in a gas-fired water heater, it will readily be appreciated by those skilled in this particular art that principles of the present invention could also be employed to advantage in other types of fuel-fired heating appliances such as, for example, boilers and other types of fuel-fired water heaters. Additionally, while a particular type of combustion air inlet flow path has been representatively illustrated and described in conjunction with the water heater 10, it will also be readily appreciated by those skilled in this art that various other air inlet path and shutoff structure configurations could be utilized, if desired, to carry out the same general principles of the present invention.

The foregoing detailed description is to be clearly understood as being given by way of illustration and example only, the spirit and scope of the present invention being limited solely by the appended claims.

What is claimed is:

1. A water heater comprising:

a tank adapted to hold a quantity of water;

a combustion chamber disposed beneath said tank and having a bottom side wall structure with a spaced series of air inlet openings therein;

a fuel burner operative to receive fuel from a source thereof and deliver the received fuel into said combustion chamber;

a hollow cylindrical skirt structure extending downwardly beyond said bottom side wall structure and having a vertical side wall portion with a spaced series of inlet openings formed therein for permitting a combustion air inflow therethrough into the interior of said hollow skirt structure for delivery therefrom into said combustion chamber, via said spaced series of combustion air inlet openings in said bottom side wall structure, for combustion with burner-delivered fuel therein; and a combustion air shutoff system operative to sense a temperature indicative of an undesirably high operating temperature within said combustion chamber and responsively terminate essentially all further combustion air inflow to said combustion chamber by blocking air flow to said combustion chamber via the interior of said skirt structure.

2. The water heater of claim 1 wherein said combustion air shutoff system includes:

linkage structure including a fusible link member disposed adjacent an exterior side portion of said bottom side wall structure, said fusible link member being meltable at said temperature indicative of an undesirably high operating temperature within said combustion chamber, and a damper member held by said linkage structure in an open position permitting operative combustion air flow through the interior of said skirt structure and into said combustion chamber via said air inlet openings in said bottom side wall structure, said damper member being urged toward a closed position in which said damper member blocks operative combustion air flow through the interior of said skirt structure, melting of said fusible link member being operative to permit movement of said damper member from said open position to said closed position.

3. The water heater of claim 2 wherein said damper member is urged by gravity from said open position toward said closed position.

4. The water heater of claim 2 wherein said damper member is spring-biased from said open position toward said closed position.

5. The water heater of claim 2 wherein:

said combustion air shutoff system further includes a first plate member horizontally secured within said skirt structure above said inlet openings therein and below said bottom side wall structure of said combustion chamber, said first plate member having an opening therein, and said damper member is a second plate member supported in said open position by said fusible link member horizontally within said skirt structure below said bottom side wall structure and above said opening in said first plate member, said second plate member being movable downwardly to said closed position, in which said second plate member rests atop said first plate member and blocks said opening therein, in response to melting of said fusible link member.

6. The water heater of claim 5 wherein said second plate member is spring-biased downwardly from said open position toward said closed position.

7. The water heater of claim 2 wherein said damper member is an annular damper slidably telescoped with said skirt structure for gravity-created downward movement from said open position, in which said annular damper is positioned above and uncovers said inlet openings in said vertical side wall portion of said skirt structure, to said closed position, in which said annular damper blocks said inlet openings in said vertical side wall portion of said skirt structure.

8. The water heater of claim 7 wherein:

said skirt structure and said annular damper have aligned retaining openings therein, said linkage structure includes a retainer arm member supported for rotation about a vertical axis and having an outer end portion which, when said annular damper is in said open position, extends through said aligned retaining openings and releasably supports said annular damper in said open position, and a spring member associated with said retainer arm member and operative, in response to melting of said fusible link member, to rotate said retainer arm member in a manner retracting said outer end portion thereof from said aligned retaining openings and permitting said annular damper to fall from said open position thereof to said closed position thereof.

9. The water heater of claim 1 wherein said spaced series of air inlet openings in said bottom side wall structure of said combustion chamber are configured to freely permit upward combustion air flow therethrough, while at the same time hinder flame outflow downwardly therethrough.

10. The water heater of claim 1 wherein said water heater is a gas-fired water heater.

11. A fuel-fired heating appliance comprising:

a combustion chamber thermally communicatable with a fluid to be heated;

a fuel supply structure operative to deliver fuel from a source thereof into said combustion chamber for mixture with a quantity of combustion air from a source thereof;

a wall structure defining a path through which the entire combustion air quantity may flow from the combustion air source into said combustion chamber for mixture and combustion with delivered fuel therein, said wall structure having a hollow cylindrical section with a side wall opening disposed therein and defining a portion of said path; and a combustion air shutoff system operative to sense a temperature indicative of an undesirably high operating temperature within said combustion chamber and responsively block essentially all of the combustion air flow through said path, said combustion air shutoff system including:

linkage structure including a fusible link member exposed to heat generated by fuel/air combustion within said combustion chamber and being meltable at said temperature indicative of an undesirably high operating temperature within said combustion chamber, and a damper member held by said linkage structure in an open position permitting operative combustion air flow through said path, said damper member being urged toward a closed position in which said damper member blocks combustion air flow through said path, melting of said fusible link member being operative to permit movement of said damper member from said open position thereof to said closed position thereof, said damper member being a flexible band member wrapped around said hollow cylindrical section of said wall structure and supported for circumferential movement relative thereto between said closed position in which said band member covers and blocks said side wall opening, and said open position in which said band member uncovers and is outwardly spaced apart from said side wall opening.

12. The fuel-fired heating appliance of claim 11 wherein said flexible band member is spring-biased toward said closed position.

13. A water heater comprising:

a tank adapted to hold a quantity of water;

a combustion chamber disposed beneath said tank and having a bottom side wall structure with a spaced series of air inlet openings therein;

a fuel burner operative to receive fuel from a source thereof and deliver the received fuel into said combustion chamber;

a hollow cylindrical skirt structure extending downwardly beyond said bottom side wall structure and having a vertical side wall portion with a spaced series of inlet openings formed therein for permitting a combustion air inflow therethrough into the interior of said hollow skirt structure for delivery therefrom into said combustion chamber, via said spaced series of combustion air inlet openings in said bottom side wall structure, for combustion with burner-delivered fuel therein; and a combustion air shutoff system operative to sense a temperature indicative of an undesirably high operating temperature within said combustion chamber and responsively shut off essentially all further combustion air inflow to said combustion chamber by blocking air flow through the interior of said skirt structure, said combustion air shutoff system including:

linkage structure including a fusible link member disposed adjacent an exterior side portion of said bottom side wall structure, said fusible link member being meltable at said temperature indicative of an undesirably high operating temperature within said combustion chamber, and a damper member held by said linkage structure in an open position permitting operative combustion air flow through the interior of said skirt structure and into said combustion chamber via said air inlet openings in said bottom side wall structure, said damper member being urged toward a closed position in which said damper member blocks operative combustion air flow through the interior of said skirt structure, melting of said fusible link member being operative to permit movement of said damper member from said open position to said closed position, said damper member being a flexible band member horizontally extending exteriorly around said skirt structure and having a first end anchored to said skirt structure, and a second end circumferentially movable away from said first end to orient said band member in said open position in which said band member is spaced outwardly apart from and uncovers said inlet openings in said skirt structure, and circumferentially movable toward said first end to orient said band member in said closed position in which said band member overlies and blocks said inlet openings in said skirt structure.

14. The water heater of claim 13 wherein said second end of said flexible band member is spring-biased circumferentially toward said first end of said flexible band member.

15. The water heater of claim 13 wherein said linkage structure extends between said bottom side wall structure and said second end of said flexible band member and includes a flexible cable member in which said fusible link member is installed.

* * * * *